US006266080B1

(12) United States Patent
Gelbart

(10) Patent No.: US 6,266,080 B1
(45) Date of Patent: Jul. 24, 2001

(54) THERMAL RECORDING WITH VARIABLE POWER DENSITY

(75) Inventor: Daniel Gelbart, Vancouver (CA)

(73) Assignee: Creo Srl, Burnaby (CA)

( * ) Notice: Subject to any disclaimer, the term of this patent is extended or adjusted under 35 U.S.C. 154(b) by 0 days.

(21) Appl. No.: 09/305,809

(22) Filed: Apr. 30, 1999

(51) Int. Cl.[7] ..... B41J 2/47
(52) U.S. Cl. ..... 347/254; 347/256
(58) Field of Search ..... 347/254, 240, 347/251, 255, 131, 256, 259; 358/456, 459, 298, 536; 359/212, 211, 380, 381, 438, 440

(56) References Cited

U.S. PATENT DOCUMENTS 4,307,408 * 12/1981 Kiyohara et al. ..... 347/255
4,651,170 * 3/1987 Chandler et al. ..... 347/259
5,111,302 * 5/1992 Chan et al. ..... 358/298
5,479,263 * 12/1995 Jacobs et al. ..... 358/298
5,521,748 * 5/1996 Saraf ..... 359/321
5,570,224 * 10/1996 Endo et al. ..... 359/212

FOREIGN PATENT DOCUMENTS

WO95/18984 * 7/1995 (WO) ..... G02B/27/00

* cited by examiner

*Primary Examiner*—N. Le
*Assistant Examiner*—Hai C. Pham
(74) *Attorney, Agent, or Firm*—Oyen Wiggs Green & Mutala

(57) ABSTRACT

The power density used during a thermal recording process is changed without changing the total energy, scanning speed or resolution. The change of power density is achieved by making the optical resolution greater than the addressability and sweeping the optical spot to write each pixel. If the optical spot is in the shape of a rectangle, a square pixel can be generated and power density is changed by changing the width of the rectangle.

16 Claims, 2 Drawing Sheets

THERMAL RECORDING WITH VARIABLE POWER DENSITY

FIELD OF THE INVENTION

The invention relates to laser recording and in particular to recording of thermal materials, also known as thermographic recording and heat-mode recording.

BACKGROUND OF THE INVENTION

In recording on photoinic materials, such as silver halide films, printing plates, photoresists, etc. it is known that the rate of exposure, or dwell time of the recording spot (typically a laser spot), is of little importance as long as the total exposure is correct. This is the well-known "Law of Reciprocity". The exposure is defined as the product of the power of the light multiplied by the time. The power is normally measured in Watts and exposure is Joules or Watt-Seconds. When recording on materials known as thermal, or heat-mode materials, the rate at which the exposure is delivered is crucial, since a low exposure rate (low power for a long time) will not cause the desired increase in temperature, as most the heat will dissipate. On the other hand shortening the exposure time and using a very high power can cause the exposed material to break down or ablate, creating debris and not functioning properly (unless the material is designed to operate by ablation). This problem does not exist in photonic materials as they usually require significantly lower power. If any exposure system has to have a specified scanning rate (to achieve a desired throughput or productivity) and the material has a specified sensitivity (usually specified in Joules/cm$^2$), these two parameters uniquely set the exposure power, since if during one second X cm$^2$ need to be exposed, the power has to be "X" times the material sensitivity. For most materials used in thermal imaging the sensitivity is in the range of 0.1–1 joule/cm$^2$ and writing rates are 10–100 cm$^2$/sec. This determines the writing power to be in the range of 1–100 W. If this power level is delivered in a single laser beam for writing high resolution features (1–20 microns) the power density (defined as Watts/cm$^2$) is very high and causes ablation. Prior art solutions involve splitting the laser beam into many parallel beams (or using many parallel lasers) in order to reduce the power density per spot. Another solution, shown in FIG. 1, is to use spots which are larger than the required addressability, shown as "a" in FIG. 1. Digital images are made up of pixels and normally addressability is a single pixel. The disadvantage of the latter method is loss of resolution as the spot is larger than a single pixel. If the first method is used it is difficult to change the power density once the power was set (to achieve a desired imaging speed). Another method is to pulse the lasers in order to increase power density, however it lowers the reliability of the lasers. For devices required to image a wide range of thermal materials it is desired to be able to vary the power density without affecting resolution, power or writing speed. It is also sometimes desired to achieve high power densities without change in resolution, power or laser duty cycle, in order to use ablative recording materials. The ideal exposure method will allow the power density to be changed from very high (for ablative materials, typically requiring 1 MV/cm$^2$) to low (for chemical reactions, typically requiring under 200 KW/cm$^2$)

SUMMARY OF THE INVENTION

The invention allows to vary the power density without affecting other imaging parameters by using an optical spot smaller than the addressability of the imaging process and scanning this spot to generate each individual pixel. One pixel is defined as the smallest element of the image, equal to one unit of addressability. If the optical spot is rectangular, with the long dimension equal to the addressability, the power density can be changed by changing the narrow dimension of the rectangle. As long as the narrow dimension of the rectangle is smaller than the addressability the resolution is practically unaffected. A second benefit of the invention is that the exposure function created by such a square spot has a steep and abrupt transition, which helps maintain the size of the written pixel even if laser power or material sensitivity are changing.

DETAILED DESCRIPTION OF THE INVENTION

Figure 1A:
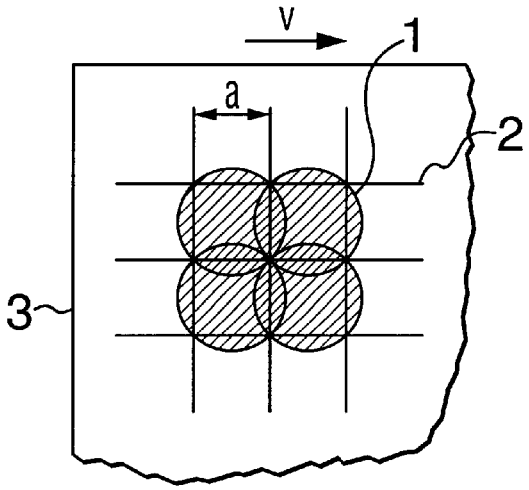
FIG. 1A PRIOR ART
FIGS. 1*a* and 1*b* show prior art method of recording and changing the power density.
Figure 1B:
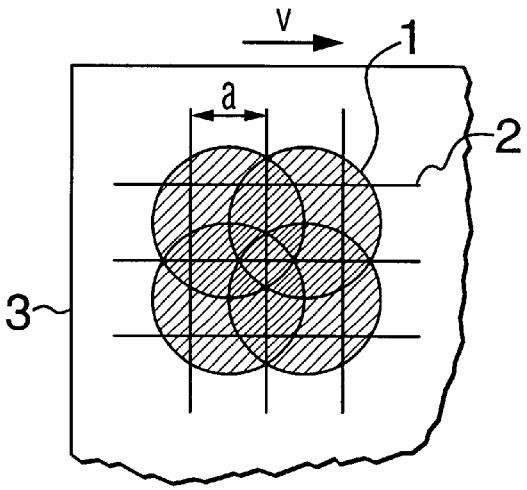
FIG. 1B PRIOR ART
Figure 2A:
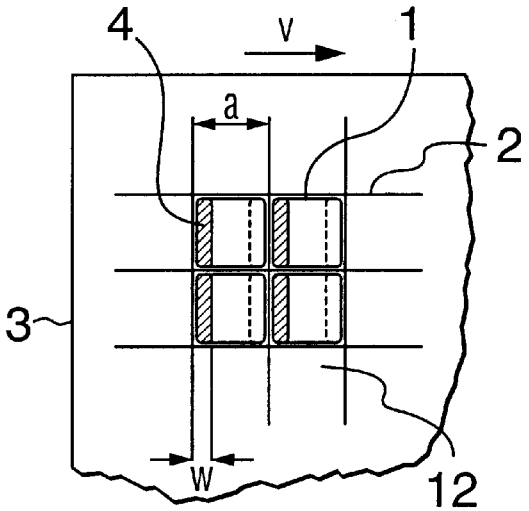
FIGS. 2*a* and 2*b* show the method of recording and changing of power density according to the invention.
Figure 2B:
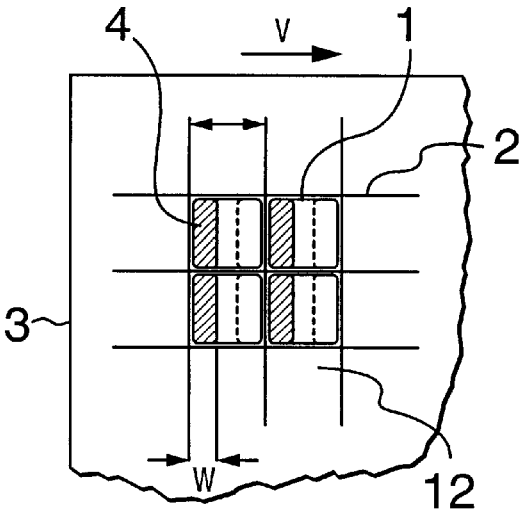

Referring now to FIG. 1 and 2, a recordable material 3 is being scanned by a recording spot 1 in order to generate an image with pixels on grid 2. The grid pitch "a" defines the addressability and pixel size. In the preferred embodiment material 3 is a thermally recordable material and spot 1 is one of the plurality of spots scanning material 3 simultaneously. To maintain the highest resolution it is desired that spot 1 will fit grid 2 perfectly, without overlapping other spots. This condition is shown in FIG. 2. This is particularly important for thermal recording as area of overlap represents a significant loss of laser power, since the temperature of the recorded material drops between recording the first spot and recording the overlapping area while recording the second spot. This heat loss is comparable to the heat loss caused by heating an object intermittently instead of continuously. In FIG. 2 spot 1 is generated by scanning a rectangular spot 4 over the area of one pixel (one grid unit). The scanning is achieved as part of the overall scanning of the image. In order to scan an image a relative motion having a velocity "v" is required. The relative motion can be generated by moving the laser spot 1 or by moving the material 3 (or both). If the scan direction is as shown by "v" and the width of the rectangular spot 4 is "w", the time the laser dwells over any point of material 3 is w/v. If w is reduced the dwell time is reduced and power density is increased, since the total power of the spot is spread over an area of a x w, giving a power density of: power per spot/a x w. Increasing w up to w=a decreases the power density without materially affecting resolution (theoretically resolution is not affected at all if the material is binary in nature and has a switching point at half the peak exposure). Making w<a has also the desired effect of sharpening the edges of the exposed spot in the scan direction.

Figure 3A:
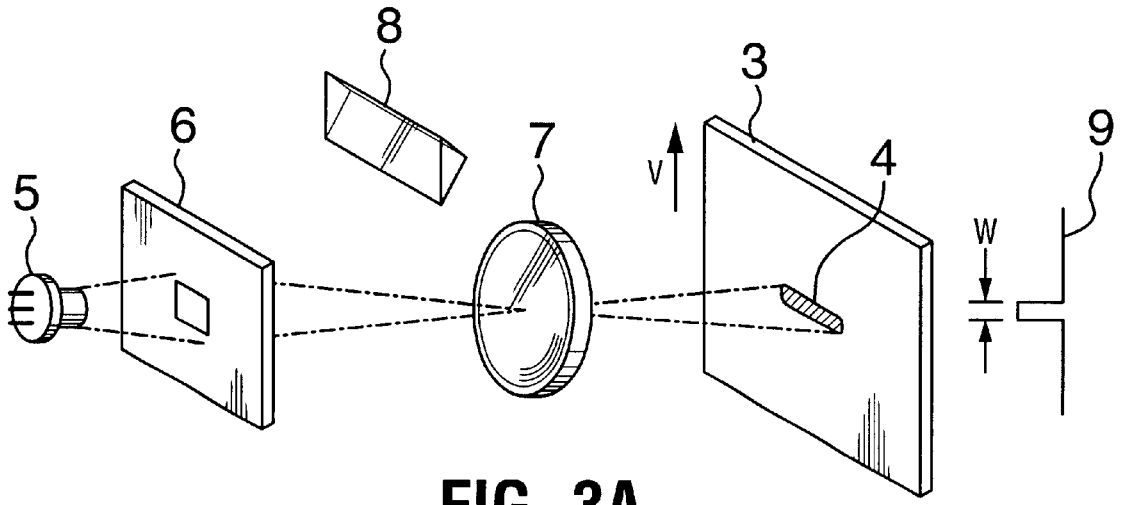
FIGS. 3*a* and 3*b* show a method of implementing the invention by inserting an anamorphic optical element into the optical system.
Figure 3B:
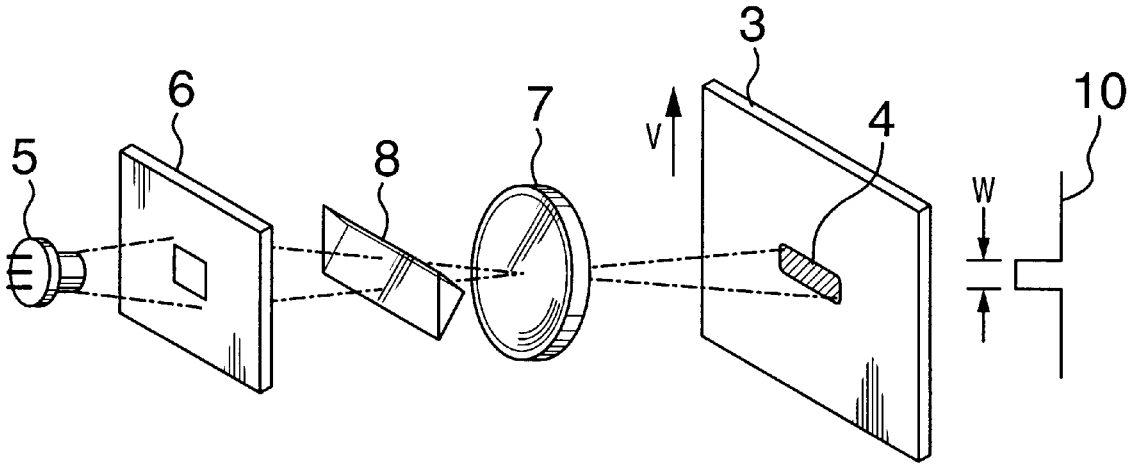

There are many known methods for generating a rectangular spot, the common one is imaging a rectangular aperture. This method is particularly suitable for using light valves for modulating the laser, since the active aperture of light valves is typically rectangular. The width w can be changed by changing the aperture of the light valve or by introducing an anamorphic optical element between the light valve and the imaging lens. Referring now to FIG. 3, laser diode 5 illuminates light valve 6 which is imaged on material 3 with lens 7 forming rectangle 4. The intensity profile of the rectangle 4 in FIG. 3-*a* is shown by schematic graph 9. By inserting anamorphic element 8 into the beam the image of 4 is widened in one dimension, as shown by schematic plot 10. Since the power in the beam remains the same, the widening causes a reduction in power density (i.e. the area under graphs 9 and 10 is equal). The anamorphic element 8 can be a prism, cylindrical lens, grating or any other optical element. It can also be made to continuously vary the width "w" by changing the position of 8 relative to lens 7 in a continuous fashion.

What is claimed is:

1. A method for generating an image made up of a plurality of pixels on a material, the method comprising:

a) setting a power density of a recording spot to be appropriate for writing on a selected material by selecting a size of the writing spot in a scanning direction, the selected size being smaller than a dimension of a pixel in the scanning direction;

b) generating a writing spot which has the selected size in the scanning direction; and, c) writing a pixel on a piece of the selected material by scanning the writing spot across the pixel in the scanning direction.

2. The method of claim 1 wherein the recording spot is rectangular and has a length which matches a height of the pixel and a width equal to the selected size.

3. The method of claim 2 wherein a ratio of the width of the recording spot to the length of the recording spot is less than or equal to 1.

4. The method of claim 2 wherein the pixels are rectangular and the scanning direction is parallel to sides of the pixels.

5. The method of claim 2 wherein the pixels are square.

6. The method of claim 1 wherein setting the power density of the spot comprises moving an anamorphic optical element to adjust the size of the writing spot in the scanning direction to the selected size.

7. The method of claim 1 wherein generating the writing spot comprises illuminating a light valve having a rectangular aperture with a light source.

8. The method of claim 7 wherein setting the power density of the writing spot comprises adjusting an aperture of the light valve.

9. An imaging system for recording an image onto a thermal recording material, the imaging system comprising:

a) a light source;

b) an optical system for focussing light from the light source onto an elongated writing spot having a narrow dimension and a wide dimension on a thermal recording material to be imaged;

c) a scanning mechanism for scanning the spot over the recording material to be imaged in a scanning direction, the scanning direction generally parallel to the narrow dimension;

wherein the optical system permits adjustment of a power density of the spot by adjusting a dimension of the writing spot in the scanning direction substantially independently of a dimension of the spot in a direction perpendicular to the scanning dimension.

10. The imaging system of claim 9 wherein the optical system comprises a light valve having a rectangular aperture and the optical system images the rectangular aperture on the thermal recording material.

11. The imaging system of claim 9 wherein the light source comprises a laser.

12. An imaging system for recording an image onto a thermal recording material, the imaging system comprising:

a) a light source;

b) an optical system for focussing light from the light source onto a writing spot on a thermal recording material to be imaged;

c) a scanning mechanism for scanning the spot over the recording material to be imaged in a scanning direction;

wherein the optical system permits adjustment of a power density of the spot by adjusting a dimension of the writing spot in the scanning direction substantially independently of a dimension of the spot in a direction perpendicular to the scanning dimension, the spot is rectangular and the optical system is adapted to permit adjustment of a narrow dimension of the rectangular spot.

13. The imaging system of claim 12 wherein the optical system comprises an anamorphic element capable of being inserted into or removed from the optical system.

14. The imaging system of claim 13 wherein the anamorphic element is selected from the group consisting of a prism, a cylindrical lens, and a grating.

15. The imaging system of claim 12 wherein the optical system comprises an anamorphic element movable to continuously adjust the narrow dimension of the rectangular spot.

16. The imaging system of claim 15 wherein the anamorphic element is selected from the group consisting of a prism, a cylindrical lens, and a grating.

* * * * *

UNITED STATES PATENT AND TRADEMARK OFFICE

CERTIFICATE OF CORRECTION

PATENT NO. : 6,266,080 B1 
DATED : July 24, 2001
INVENTOR(S) : Gelbart, Daniel and Richardson, Douglas It is certified that error appears in the above-identified patent and that said Letters Patent is hereby corrected as shown below:

Title page,
Item [75], "[75] Inventor: Daniel Gelbart, Vancouver (CA)" is replaced with
-- [75] Inventors: Daniel Gelbart, Vancouver (CA)
Douglas Richardson, Port Moody (CA) --

Signed and Sealed this

Fifteenth Day of October, 2002

*Attest:*

*Attesting Officer*

JAMES E. ROGAN
*Director of the United States Patent and Trademark Office*